United States Patent [19]

Keene

[11] Patent Number: 4,615,797

[45] Date of Patent: Oct. 7, 1986

[54] DRY WASHER WITH HOT AIR SUPPLY

[76] Inventor: Wayne G. Keene, 9330 Corbin Ave., Northridge, Calif. 91324

[21] Appl. No.: 649,931

[22] Filed: Jun. 18, 1985

[51] Int. Cl.[4] ..... B03C 7/04; B07B 9/00

[52] U.S. Cl. ..... 209/131; 209/127.2; 209/127.3; 209/11; 209/44; 209/466; 165/51; 165/119

[58] Field of Search ..... 209/131, 474, 127.2, 209/127.3, 475, 466, 467, 468, 469, 130, 11, 502, 504, 44; 165/51, 119

[56] References Cited

U.S. PATENT DOCUMENTS

| | | | |
|---|---|---|---|
| 613,143 | 9/1898 | Harris | 209/11 |
| 1,701,624 | 2/1929 | Lide | 209/467 |
| 2,116,613 | 5/1938 | Bedford | 209/131 |
| 2,161,500 | 6/1939 | Bird et al. | 209/502 X |
| 3,773,174 | 11/1973 | Stimpel | 209/131 |
| 4,231,717 | 11/1980 | Onishi | 165/51 |
| 4,411,038 | 9/1983 | Mukai | 209/466 X |

*Primary Examiner*—Kenneth M. Schor
*Assistant Examiner*—Thomas M. Lithgow
*Attorney, Agent, or Firm*—Emmette R. Holman

[57] ABSTRACT

The electrostatic recovery of gold in the drywasher is improved by providing means to scavenge the waste heat from the internal combustion engine that powers the air blower. This preheats the intake air to the air blower, whereby the equilibrium temperature of the compressed air delivered to the partially fluidized bed of ore particles on the riffle table is raised about 50° F. above ambient temperature. The layer of fabric underlying the bed of particles is maintained at bone dryness, the ore particles are dried, and the electrostatic forces operate under most favorable conditions at low relative humidity.

4 Claims, 8 Drawing Figures

37
38
39
34
36
1
36
35
35
4
21
24
28
30
35
31
29
27
23
7
27
27
3
26
6
9
35
34
33
32
17
27
2

DRY WASHER WITH HOT AIR SUPPLY

BACKGROUND OF THE INVENTION

This invention relates to the recovery of values, such as gold, from particles of ore in the dry washer. In this process the ore particles are deposited on a riffle table which is covered with a layer of densely woven fabric. The top surface of the riffle table, hereinafter referred to as the core, is densely perforated throughout. The core is also the top, or ceiling, of the air plenum chamber. The core supports the layer of fabric. Compressed air is delivered into the air plenum chamber, from whence it escapes upwardly through the perforations in the core, through the thickness of the fabric layer and through the depth of the bed of particles thereover. The upflow of air tends to fluidize at least the lighter and more buoyant particles in the bed.

One end of the riffle table is elevated to a selected angle. The layer of fabric is held in position by a plurality of about seven transverse, horizontal riffle barriers which engage opposing side walls of the riffle table. The riffle table is walled at the elevated end and at both sides. Means are provided to support the riffle table above ground and at the desired angle but, at the same time, to provide freedom of the table to oscillate with orbital motion coplanarly with the core. An oscillator, rigidly clamped to the air plenum chamber inlet is driven by the flow of air thereinto. It is an eccentric weighted crank on one end of a shaft which is shared by a propeller on the opposite end. The shaft is coaxially aligned with the compressed air duct entering the air plenum chamber.

An air blower powered by an internal combustion engine compresses ambient air for delivery to the air plenum chamber via an interconnecting length of flexible air conduit of dielectric material.

In the prior art, one typical assembly train of this type is described by Thomas Stimpel in U.S. Pat. No. 3,773,174, which issued on Nov. 20, 1973. Stimpel's contribution to the art consists of providing in each perforation in the core of the riffle table a hemispherical bell opening facing the overlying layer of fabric. It is claimed that this provides space for cyclonic whirls which create an electrostatic charge on the fibers of the fabric.

A different approach was taken by Robert H. Bedford in U.S. Pat. No. 2,116,613, which issued on May 10, 1938. In this case the core is a horizontal metal screen connected to the negative lead from an electrostatic generator with the dielectric fabric layer superimposed thereover. The metal screen is electrically insulated from all other component parts of the riffle table/air plenum chamber assembly. The positive lead from the generator is connected to an overhead hopper, which receives the ore particles and delivers them by gravity drop to the riffle table. The particles acquire a positive charge in accordance with their composition, it is claimed, with the metal particles acquiring the higher charge. The Bedford concept treats the separation of the heavier concentrate particles from the lighter particles in the fluidized bed by dividing the bed into two compartments with a dam extending below the surface of the bed but not all the way to the bottom, thus permitting only the heavier fluidized layer of concentrate to pass under the dam, precisely as in the case of separating two immiscible liquids of different densities. The compartment on each side of the dam is provided with its own spillway, wherefrom the heavier values spill over at a lower elevation on one side and the exhausted tailings spill over at a higher elevation on the opposite side. According to Bedford, the electrostatic field is intended to augment the effectiveness of the gravity separation process.

There is no teaching in the cited prior art of heating of the compressed air, of maintaining bone dryness of the fibers in the fabric layer, or of drying the ore particles in the bed, which is the very essence of the present invention.

The improvement of the present invention consists of providing a heat collector shroud to enclose the finned heat radiating surface area and the cylindrical surface of the exhaust muffler of the air-cooled internal combustion engine which powers the air blower. The shroud has a hot air outlet.

In addition, the air inlet to the volute of the blower engages, mouth-to-mouth, the outlet of a blower case. The blower case has a hot air inlet which is connected to the hot air outlet of the heat collector shroud by means of an appropriate length of duct of dielectric material. Thus the heat from the engine that is normally discharged into the atmosphere, is scavenged, according to the invention, to heat up the compressed air to about 50° F. above ambient temperature at no extra cost for fuel.

DETAILED DESCRIPTION AND DISCUSSION

Figure 1:
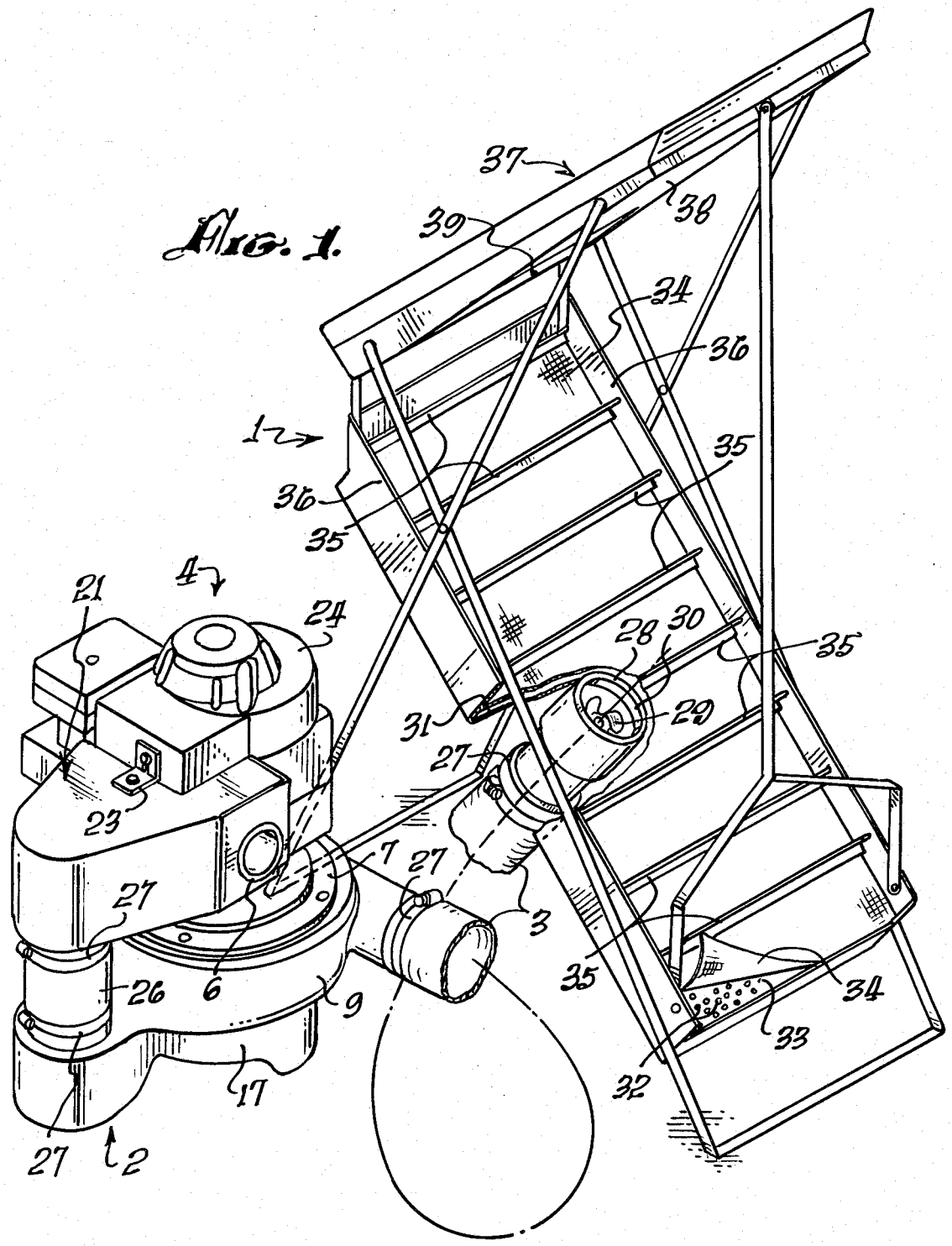
FIG. 1 is a view in perspective, with portions broken away to show interior details, of the dry washer assembly train of the invention.

The complete dry washer assembly train is seen in FIG. 1. It consists of a riffle table assembly, generally indicated as (1), a blower assembly, generally indicated as (2) and their interconnecting flexible conduit (3).

Figure 2:
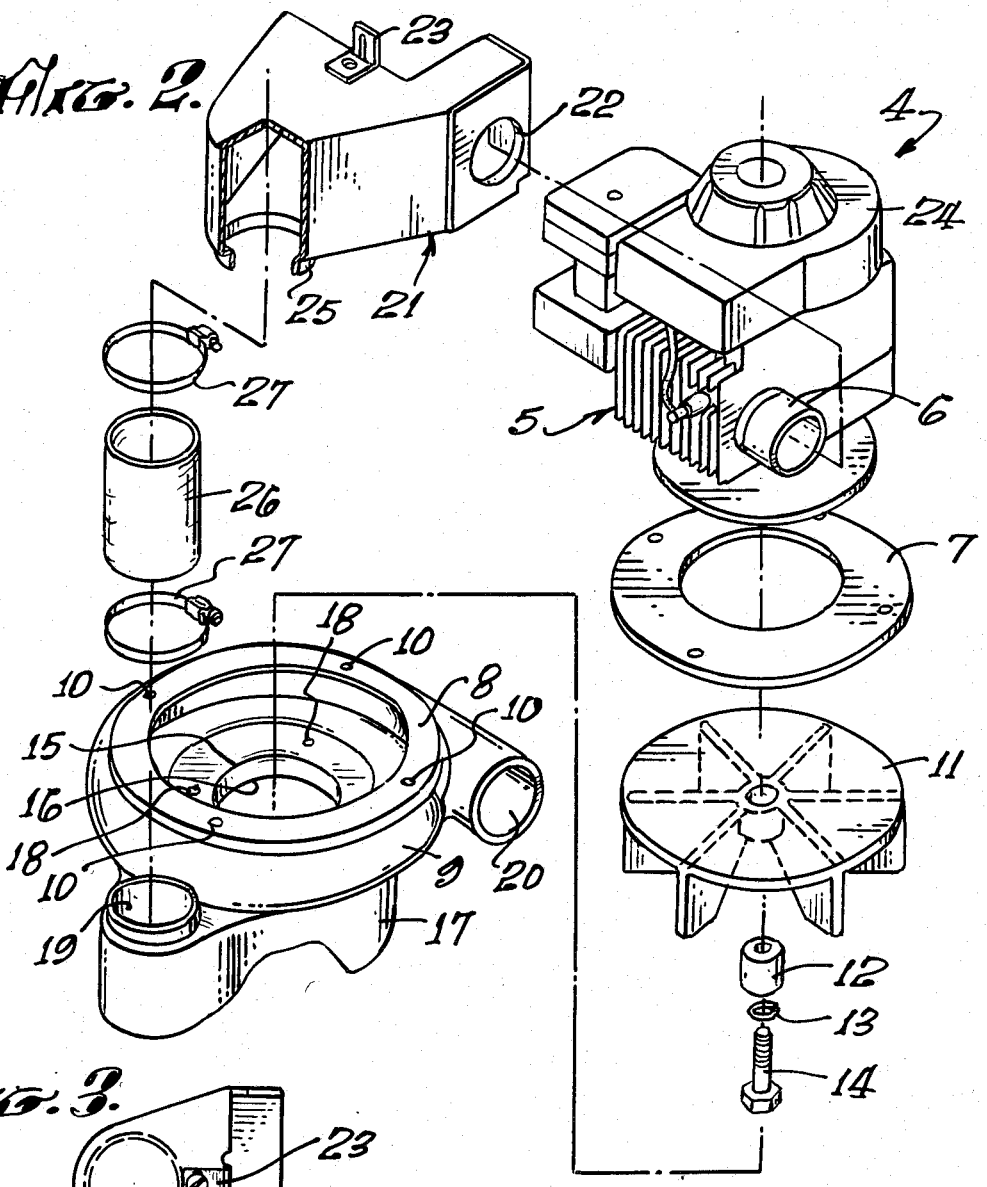
FIG. 2 is an exploded view in perspective of the blower assembly of FIG. 1 with a quadrant section of the heat collector shroud cut away to show interior detail.
Figure 3:
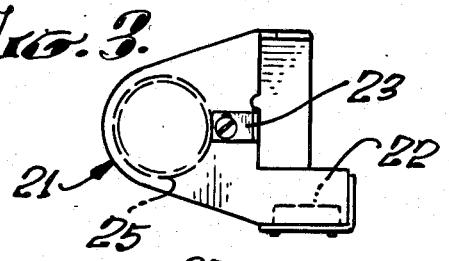
FIGS. 3, 4, 5 and 6 are top plan-, front elevation-, side elevation- and bottom plan-views, respectively of the heat collector shroud of FIG. 2.
Figure 4:
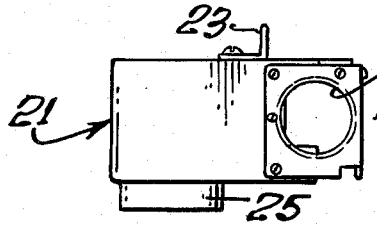
Figure 5:
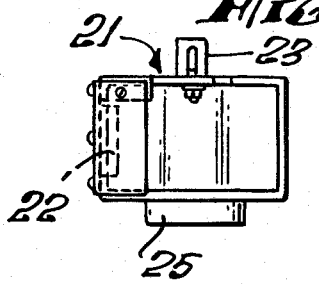
Figure 6:
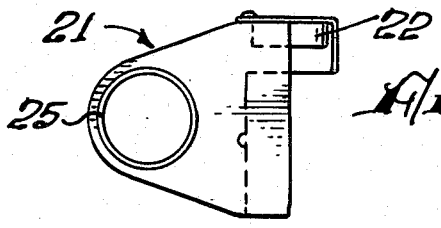
Figure 7:
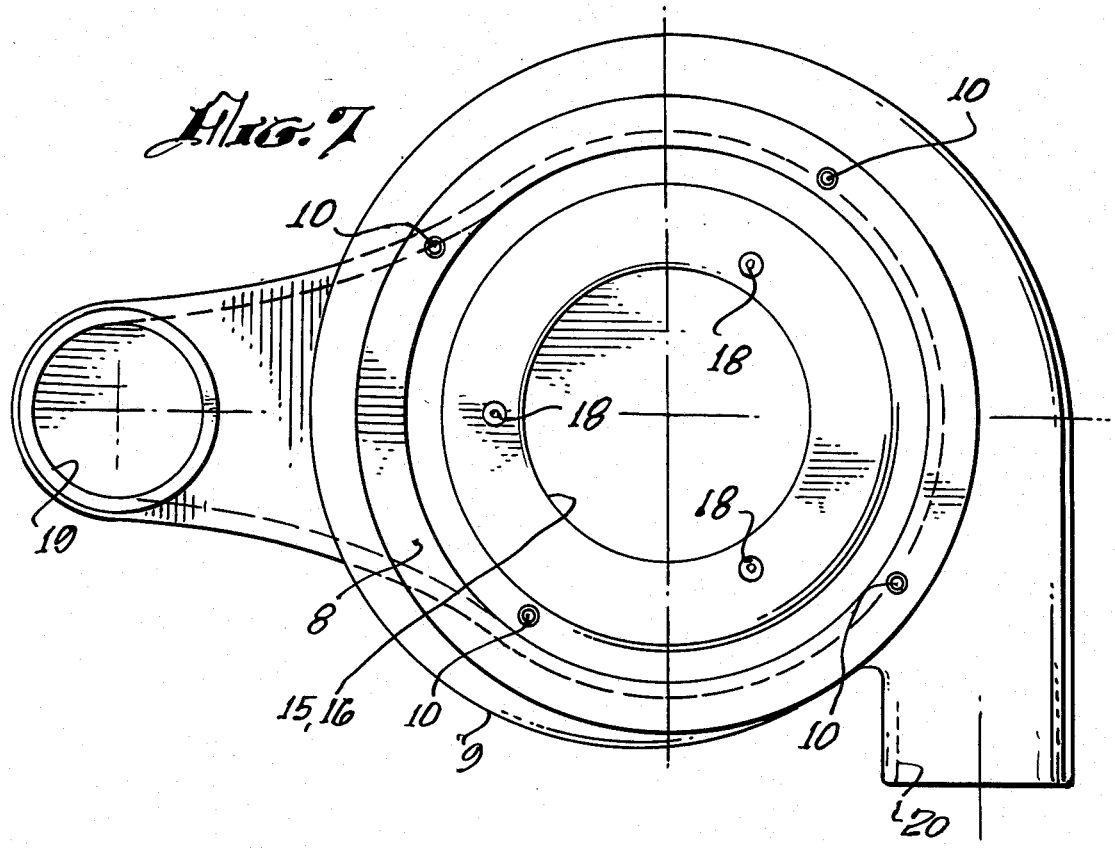
FIGS. 7 and 8 are top plan- and front elevation-views, respectively, of the blower case of FIG. 2.
Figure 8:
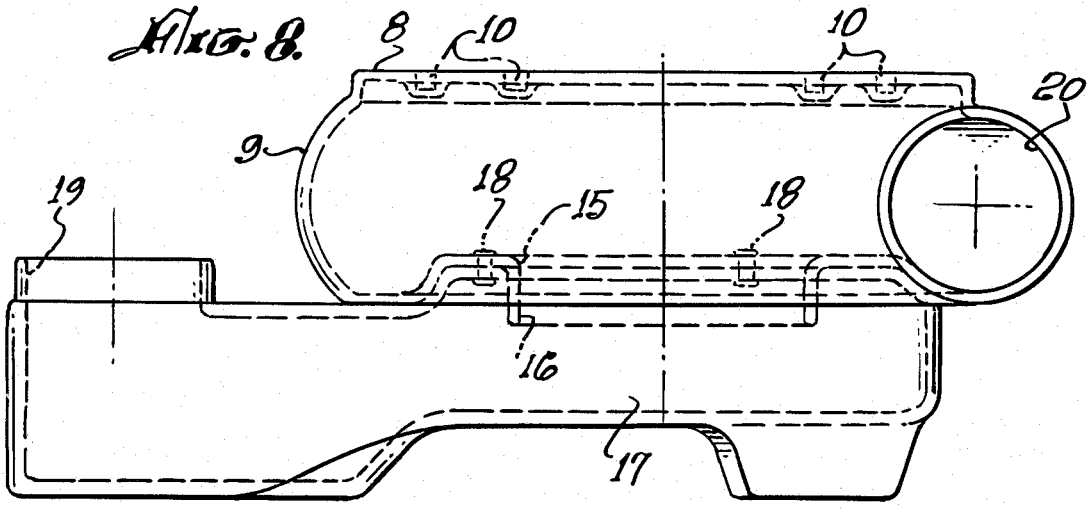

Referring to FIG. 2, the blower assembly 2 is powered by an internal combustion engine, generally indicated as (4), which is air-cooled by external finned surfaces which are concentrated in an area, generally indicated as (5). The engine 4 has a cylindrical exhaust muffler (6) located in close proximity to 5. The engine 4 is bolted to a horizontal adapter ring (7) which is coaxial with the vertical crankshaft, not shown, of the engine. Ring 7 is adapted to securely engage the top rim (8) of the volute (9) of the blower via four equally disposed threaded holes (10). Impeller (11) fits over the shaft of engine 4 and is secured thereto by means of a steel bushing (12), lockwasher (13) and screw (14), which engages the end of the shaft by means of a coaxially threaded hole bored therein.

Volute 9 has air inlet (15) which is coaxially aligned with impeller 11 in opposition to top rim 8. Inlet 15 engages outlet (16) of blower case (17) in mouth-to-mouth fashion. Blower case 17 is rigidly attached to volute 9 by means of three equally-spaced rivets (18). Blower case 17 has an upwardly directed inlet opening (19) and outlet opening (20).

The heat collector shroud, generally indicated as (21), is provided in its front face with a short length of re-entrant tube (22), which is adapted to surround a portion of the cylindrical surface of the exhaust muffler 6 adjacent to the outlet face of 6. The top face of shroud 21 is provided with an angular bracket (23) which has a slotted opening adapted to adjustably receive a screw, whereby it is rigidly secured to the side face of the reel housing (24) of engine 4. The bottom face of shroud 21 has a downwardly-directed hot air outlet (25). Preferably, outlet 25 is coaxially aligned with inlet 19. Outlet 25 is connected to inlet 19 by means of a flexible suction duct (26) which is secured, respectively, at each end, by means of hose clamps (27).

Under conditions of sustained operation, engine 4 will warm up and radiate waste heat from the surfaces of finned area 5 and from the cylindrical surface of exhaust muffler 6. This waste heat is captured by air entering the air inlet of the heat shroud drawn in by the blower. The hot air in shroud 21 is withdrawn via outlet 25, suction duct 26 and blower case 17 into volute 9 of the blower. The air is compressed by impeller 11 in the volute and exits via outlet 20, through pressurized air duct 3, to oscillator 28, where it propels the turbine blades (29) thereof to generate orbital motion coplanar with the riffle table. Oscillator 28 is rigidly clamped to hot air inlet (30) of plenum chamber (31). The hot air in plenum chamber 31 reaches an steady state temperature of about 50° F. above ambient air temperature. Due to the re-entrant tube 22 in shroud 21, this hot air is substantially free from contamination by exhaust gases. The compressed hot air escapes from the plenum chamber 31 via the hundreds of perforations (32) in the core (33) of the riffle table and permeates upwardly through layer (34) of densely woven fabric which is supported on top of core 33 and is secured against core 33 by means of a plurality of about seven transverse, horizontal riffle barriers (35), which are wedged between opposed side walls (36) of the riffle table. The hot air completes its upwardly course by its passage through a bed of ore particles (not shown) which bed is at least partially fluidized by the updraft as the ore particles cascade down the incline of the top surface of fabric layer 34 and its riffle barriers 35, whence the hot air escapes into the atmosphere.

In actual operation, the ore is deposited, as by hand shovel, near the top of an inclined ½ inch mesh screen assembly, generally indicated as (37), which oscillates in unison with the riffle table below, which is suspended from it. A chute (38) is integrated with the screen and hangs immediately beneath it. The coarse ore particles, rejected by the screen, roll down the incline and drop to the ground from the lower end. The finer ore particles pass through the screen, drop into chute 38 and tumble down the inclined chute to its transverse opening (39), wherefrom they drop to feed the top end of the inclined riffle table. The ore particles descend as a layer down the inclined riffle table while simultaneously passing through the uniformly distributed updraft of hot air rising therefrom.

The ore concentrate collects on the fabric layer 34 and in the drifts that collect upstream of the riffle barriers 35, while the exhausted tailings work their way down the incline to drop off to the ground at the lower end.

It is believed that the updraft of hot dry air maintains the fabric layer 34 in bone dry condition and more highly charged electrostatically than is possible under ambient, less dry conditions with unheated air. It is also believed that each discrete grain of ore is actually a clustered aggregate of fine particles, including values, adhering to each other and to a larger host particle, held together by the capillarity of traces of ambient moisture occluded within the cluster. This occluded moisture is incompletely removed in an updraft of unheated air. In an updraft of hot air, however, the ore dries more quickly and completely. At the instant of incipient dryness of the clustered ore particle the capillary attractive forces vanish and electrostatic charges of like polarity build up the constituent particles causing the cluster to disintegrate in consequence of the mutual electrostatic repulsion. It is also believed that a higher proportion of the ore particles in the bed is fluidized when the updraft air is heated. Therefore the electrostatic recovery of values is improved: (a) by the stronger electrostatic field of the bone dry fabric; (b) by the absence of capillary moisture within the clustered grain of ore and the tendency of this moisture to reduce the strength of the electrostatic field; (c) by the disintegration of the clustered grain aggregates to expose the fine values cemented therein; and (d) by improved fluidization of the ore.

Conceivably, the ore particles could be predried in a dryer prior to feeding on the riffle table. However, this would require extra fuel and the transportation of a bulky, heavy and expensive dryer into difficultly accessible mountain areas. The treatment of such predried ore on the drywasher supplied with unheated air at ambient temperature and ambient relative humidity cannot provide continuous bone dryness in the fabric layer 34. The electrostatic field strength of the fabric layer is substantially less than under bone dry conditions. By comparison, the heavy, bulky separate dryer is replaced, according to the invention, by the heat collector shroud 21, plus the blower case 17 and the interconnecting hot air suction duct 26 which, collectively, add only a few ounces to the transportable weight of equipment. No extra fuel is needed in the one stage operation of this invention versus the two stage operation with added dryer, which does require extra fuel.

SUMMARY AND CONCLUSION

It is an object of the invention to supply hot, dry, compressed air into the plenum chamber of the riffle table, whereby to improve the efficiency of the electrostatic recovery of values from the ore.

It is another object of the invention to scavenge the waste heat of the internal combustion engine that powers the blower for the purpose of heating the compressed air at no additional cost for fuel.

These objectives are achieved, according to the invention, by providing an extension of the suction side of the blower assembly which extension consists of: a blower case having a hot air outlet in mouth-to-mouth engagement with the inlet of the volute of the blower, a heat collector shroud enclosing the finned heat radiating surface area of the engine and the cylindrical surface of its exhaust muffler and, lastly, a length of suction duct interconnecting the shroud outlet to the blower case inlet, whereby the temperature of the compressed air in the plenum chamber of the riffle table is heated to about 50° F. above ambient air temperature under steady state conditions of sustained operation. To exclude contamination of the hot air by exhaust gases, the heat collector shroud is provided with a short length of re-entrant metal tube which encircles the cylindrical surface of the exhaust muffler adjacent the exhaust outlet end of the cylindrical surface.

I claim:

1. In a dry washer assembly train for the electrostatic recovery of values from particles of ore deposited at the elevated end of an inclined, oscillating, rectangular riffle table causing said particles to slowly tumble downwardly thereover and cascade over a plurality of transverse, horizontal riffles, said dry washer assembly train consisting of:

(a) an air blower powered by an air-cooled internal combustion engine having a vertical side wall identified as the external spark plug face, a reel housing on top of said engine enclosing the upper portion thereof, said spark plug face having a finned surface area for the dissipation of waste heat of combustion, said engine having an exhaust muffler, said blower having an inlet and an outlet;

(b) a densely perforated, inclined, rectangular riffle table core bordered by walls at said elevated end and along both sides, said perforated core being the ceiling of an air plenum chamber, said chamber being provided with an air inlet, said core with said three walls and said air plenum chamber comprising a unitary body assembly;

(c) a layer of densely woven fabric of synthetic dielectric fibers overlying said perforated riffle table core, said transverse horizontal riffles being adapted simultaneously to engage the opposed side walls and to secure said layer of fabric to said riffle table core;

(d) an air-driven oscillator to provide orbital motion coplanar with said layer of fabric, said oscillator having an air outlet adapted for rigid clamped engagement with said air plenum chamber inlet and having an air inlet;

(e) a flexible first air conduit of dielectric material connected at one end to said air blower outlet and at the other end to said oscillator inlet; and (f) means to support said riffle table above ground and at the desired angle of inclination;

the improvement consisting of providing in combination:

(g) a heat collector shroud bolted to said reel housing, enclosing said finned surface area and a major portion of said exhaust muffler, said heat collector shroud having an air outlet in the bottom of said heat collector shroud and an air inlet; and (h) a blower case with outlet connected mouth to mouth with said inlet of said air blower, said blower case having an inlet connected to said outlet in the bottom of said heat collector shroud outlet by means of a second air conduit of dielectric material;

whereby, in continuous operation of said engine, the ambient air inspired at said inlet of said heat collector shroud is heated in its passage therethrough and, in completing its passage through each component unit along said dry washer assembly train in succession, arrives in said air plenum chamber at about 50° F. above the temperature of said ambient air under steady state conditions.

2. A dry washer assembly train according to claim 1, wherein said exhaust muffler has a cylindrical surface and said heat collector shroud is provided with a re-entrant metal tube which surrounds a portion of the cylindrical surface of said exhaust muffler adjacent to the exhaust outlet end of said cylindrical surface, whereby the exhaust heat thereof is scavenged without the inspiration of exhaust fumes into said heat collector shroud.

3. A dry washer assembly train according to claim 2, wherein said air blower has an impeller, a volute and an intake opening in said volute, said intake opening being in coaxial alignment with said impeller and with said blower case outlet.

4. A dry washer assembly train according to claim 3, wherein said blower case inlet is in vertical coaxial alignment with said heat collector shroud outlet.

* * * * *